US009410374B2

(12) United States Patent
Shanks

(10) Patent No.: US 9,410,374 B2
(45) Date of Patent: Aug. 9, 2016

(54) LADDER LIFT

(71) Applicant: Robert Horton Shanks, Sheffield, MA (US)

(72) Inventor: Robert Horton Shanks, Sheffield, MA (US)

( * ) Notice: Subject to any disclaimer, the term of this patent is extended or adjusted under 35 U.S.C. 154(b) by 0 days.

(21) Appl. No.: 14/253,776

(22) Filed: Apr. 15, 2014

(65) Prior Publication Data

US 2015/0060200 A1 Mar. 5, 2015

Related U.S. Application Data

(60) Provisional application No. 61/873,041, filed on Sep. 3, 2013.

(51) Int. Cl.

| | |
|---|---|
| ***E06C 7/16*** | (2006.01) |
| ***E06C 1/39*** | (2006.01) |
| ***E06C 1/397*** | (2006.01) |
| ***E06C 7/18*** | (2006.01) |

(52) U.S. Cl.

CPC ... *E06C 7/16* (2013.01); *E06C 1/39* (2013.01); *E06C 1/397* (2013.01); *E06C 7/183* (2013.01)

(58) Field of Classification Search

CPC ..... E06C 7/16; E06C 7/12; E06C 7/181; E06C 7/183; E06C 1/39; E06C 1/397

See application file for complete search history.

(56) References Cited

U.S. PATENT DOCUMENTS

| | | | | | |
|---|---|---|---|---|---|
| 2,762,659 | A * | 9/1956 | Harlan et al. | ..... | 182/141 |
| 3,081,839 | A * | 3/1963 | O'Brien | ..... | 182/103 |
| 3,176,794 | A * | 4/1965 | Evans et al. | ..... | 182/17 |
| 3,232,377 | A * | 2/1966 | Smith | ..... | 182/115 |
| 3,276,542 | A * | 10/1966 | Pommier | ..... | E04G 1/24 182/152 |
| 3,428,145 | A * | 2/1969 | Lyon | ..... | 182/103 |
| 3,476,212 | A * | 11/1969 | Eakins | ..... | 182/103 |
| 3,737,007 | A * | 6/1973 | Herrell | ..... | E06C 1/397 182/103 |
| 4,798,262 | A * | 1/1989 | Margolies | ..... | 182/106 |
| 5,033,582 | A * | 7/1991 | Hoben | ..... | 182/85 |
| 6,283,249 | B1 * | 9/2001 | Young et al. | ..... | 182/17 |
| 7,370,725 | B1 * | 5/2008 | Dornfeld | ..... | 182/2.2 |
| 8,011,473 | B1 * | 9/2011 | Gregersen | ..... | 182/102 |
| 8,251,179 | B2 * | 8/2012 | Anderson et al. | ..... | 182/106 |
| 2001/0047905 | A1 * | 12/2001 | Boyer | ..... | E06C 1/397 182/15 |

FOREIGN PATENT DOCUMENTS

| | | | | |
|---|---|---|---|---|
| DE | 2729381 | * | 1/1979 | ..... B66B 9/02 |
| WO | WO 9729041 | A1 * | 8/1997 | ..... B66F 11/04 |

* cited by examiner

*Primary Examiner* — Colleen M Chavchavadze
(74) *Attorney, Agent, or Firm* — Dunlap Bennett & Ludwig PLLC

(57) ABSTRACT

A ladder lift is provided. The ladder lift may include a foldable platform, a frame, a motorized gear mechanism, a gear channel and a toggle switch. The gear channel may extend upwardly from a supporting surface along the length of the frame. The gear channel may house a belt track extending along the length of the gear channel. The foldable platform may be rigidly connected to the motorized gear mechanism. The motorized gear mechanism may selectively engage the belt track for causing the foldable platform to move in a specified direction along the length of the gear channel. The toggle switch may be used to engage and disengage the motorized gear mechanism. The frame may support the gear channel, the foldable platform, the motorized gear mechanism and a user. The user may be accommodated on the foldable platform. Then the user may activate the toggle switch so that the foldable platform moves in a specified direction along the length of the gear channel for a predetermined distance.

5 Claims, 4 Drawing Sheets

LADDER LIFT

CROSS-REFERENCE TO RELATED APPLICATION

This application claims the benefit of priority of U.S. provisional application No. 61/873,041, filed 11 Sep. 2013, the contents of which are herein incorporated by reference.

BACKGROUND OF THE INVENTION

The present invention relates to lift apparatuses and, more particularly, to a device adapted to carry a person up and down along a foldable ladder.

The elderly and handicapped tend to have trouble going up and down on ladders. Generally, climbing up and down ladders can be dangerous for the young and old. More and more, doctors order older people to stay off ladders. As a result, many elderly lose some of their independence.

As can be seen, there is a need for a ladder that goes up and down electrically, obviating the need for one to physically climb and descend the rungs.

SUMMARY OF THE INVENTION

In one aspect of the present invention, a ladder lift comprises: a frame of rigid material having sufficient strength to accommodate use by a human being; a gear channel housing a belt track, wherein the gear channel is supported by the frame; a foldable platform comprising: a vertical plate having a first end and a second end; and a horizontal plate, wherein the vertical plate and the horizontal form a general L-shape; and a motorized gear mechanism connected to the vertical plate, wherein the motorized gear mechanism mechanically engages the belt track for causing the foldable platform to move along the length of the gear channel.

In another aspect of the present invention, a method of elevating a user comprises: proving a ladder lift comprising: a frame of rigid material having sufficient strength to accommodate use by a human being; a gear channel housing a belt track, wherein the gear channel is supported by the frame; a foldable platform comprising: a vertical plate having a first end and a second end; and a horizontal plate, wherein the vertical plate and the horizontal form a general L-shape; and a motorized gear mechanism connected to the vertical plate, wherein the motorized gear mechanism mechanically engages the belt track for causing the foldable platform to move along the length of the gear channel; accommodating a user on the foldable platform; and activating the motorized gear mechanism so that it moves along the length of the gear channel in a specified direction.

These and other features, aspects and advantages of the present invention will become better understood with reference to the following drawings, description and claims.

DETAILED DESCRIPTION OF THE INVENTION

Figure 1:
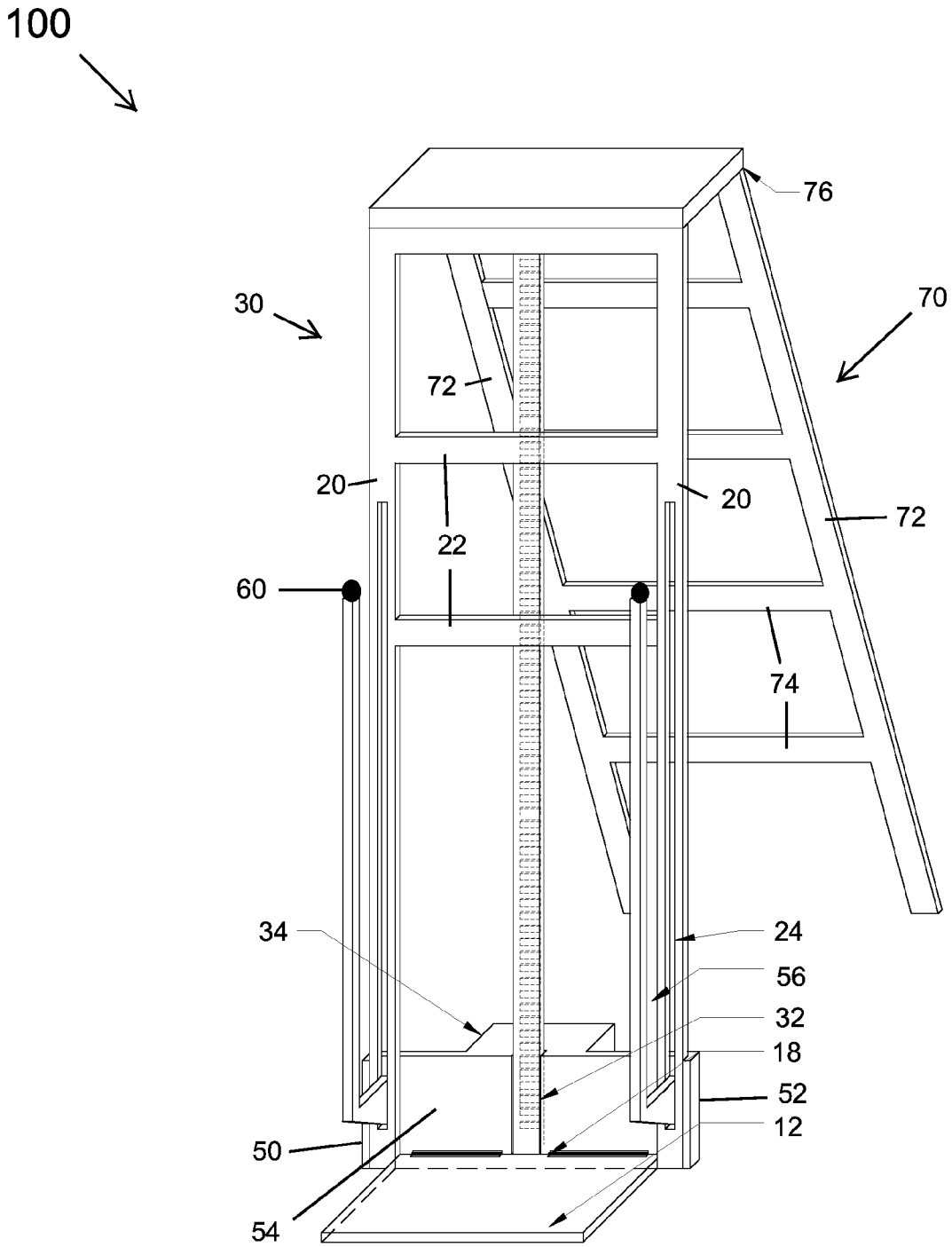
FIG. 1 is a perspective view of an exemplary embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a ladder lift. The ladder lift may include a foldable platform, a frame, a motorized gear mechanism, a gear channel and a toggle switch. The gear channel may extend upwardly from a supporting surface along the length of the frame. The gear channel may house a belt track extending along the length of the gear channel. The foldable platform may be rigidly connected to the motorized gear mechanism. The motorized gear mechanism may selectively engage the belt track for causing the foldable platform to move in a specified direction along the length of the gear channel. The toggle switch may be used to engage and disengage the motorized gear mechanism. The frame may support the gear channel, the foldable platform, the motorized gear mechanism and a user. The user may be accommodated on the foldable platform. Then the user may activate the toggle switch so that the foldable platform moves in a specified direction along the length of the gear channel for a predetermined distance.

Referring to FIGS. 1 through 6, the present invention may include a ladder lift 100. The ladder lift 100 may include a foldable platform 10, a frame 30, a motorized gear mechanism 34, a gear channel 32 and at least one toggle switch 60. The ladder lift 100 may be formed from a rigid material that is able to fully support a predetermined weight of a human being.

The foldable platform 10 may include a horizontal plate 12 pivotably joined to a vertical plate 14 along a hinge edge 18. The hinge edge 18 may include at least one piano hinge 19 or the like. The horizontal plate 12 and the vertical plate 14 may form an "L" shape. The horizontal plate 12 may be sized to accommodate a predetermined size of a human being. The vertical plate 14 may have a first end 50, a second end 52, a plate side 54 and a mechanism side 58.

The vertical plate 14 may include two upwardly extending elongated handles 56 disposed near the first end 50 and the second end 52 respectively. The elongated handles 56 may be adapted for a user to maintain their balance while standing on the foldable platform 10. In certain embodiments the two handles 56 may include safety belts adapted to secure the user while standing on the foldable platform 10. Each elongated handle 56 may include at least one toggle switch 60. In certain embodiments, the at least one toggle switch 60 may be positioned in any location on the ladder lift 100 so as to allow the user easy access thereto.

Figure 2:
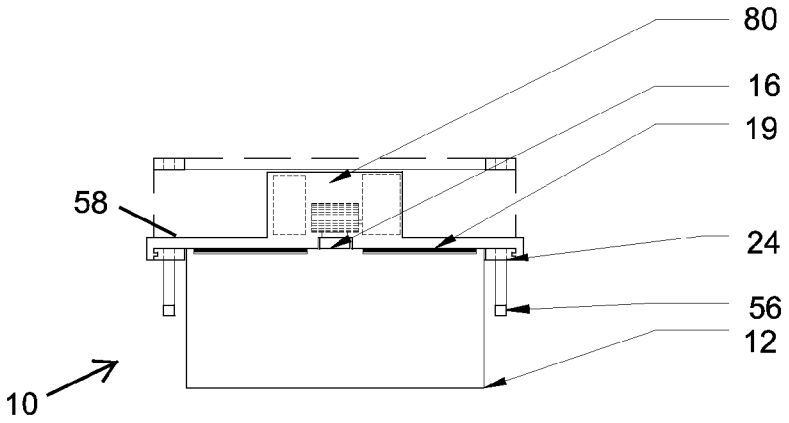
FIG. 2 is a plan view of an exemplary embodiment of the present invention.
Figure 3:
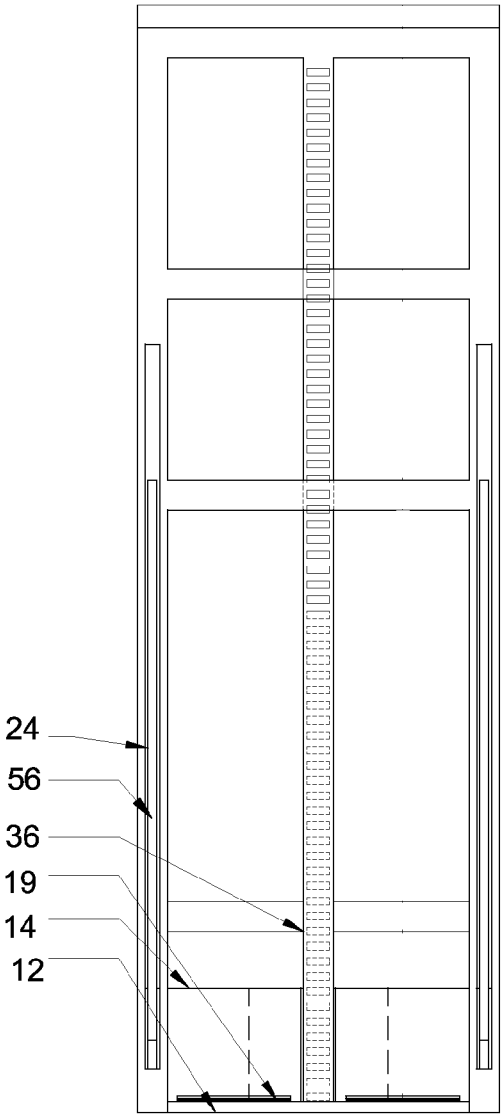
FIG. 3 is a front elevation view of an exemplary embodiment of the present invention.

In certain embodiments, the vertical plate 14 may define a vertical aperture 16 for slidably receiving the gear channel 32, as illustrated in FIG. 2. The vertical plate 14 may include the motorized gear mechanism 34 generally centered on the mechanism side 58 between the first end 50 and the second end 52 so as to straddle the vertical aperture 16.

Figure 4:
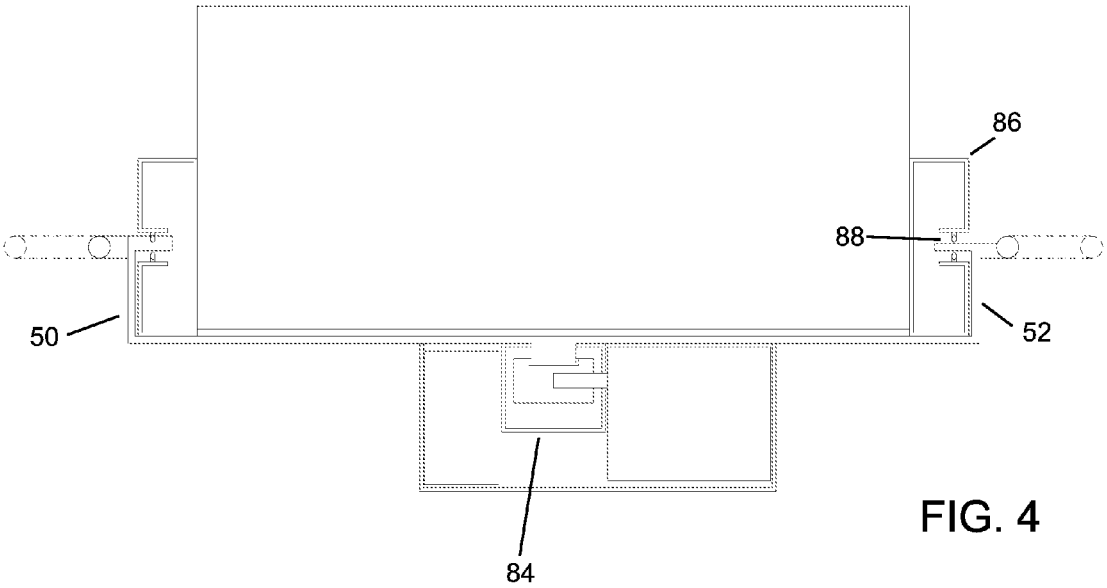
FIG. 4 is a plan view of an exemplary embodiment of the present invention.
Figure 5:
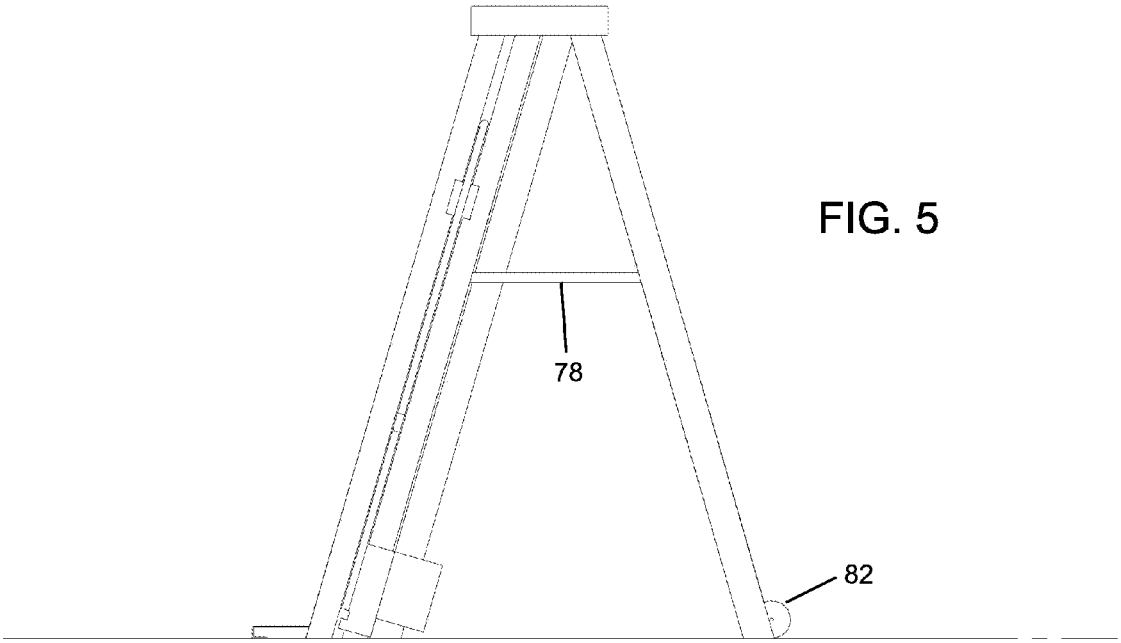
FIG. 5 is a side elevation view of an exemplary embodiment of the present invention.
Figure 6:
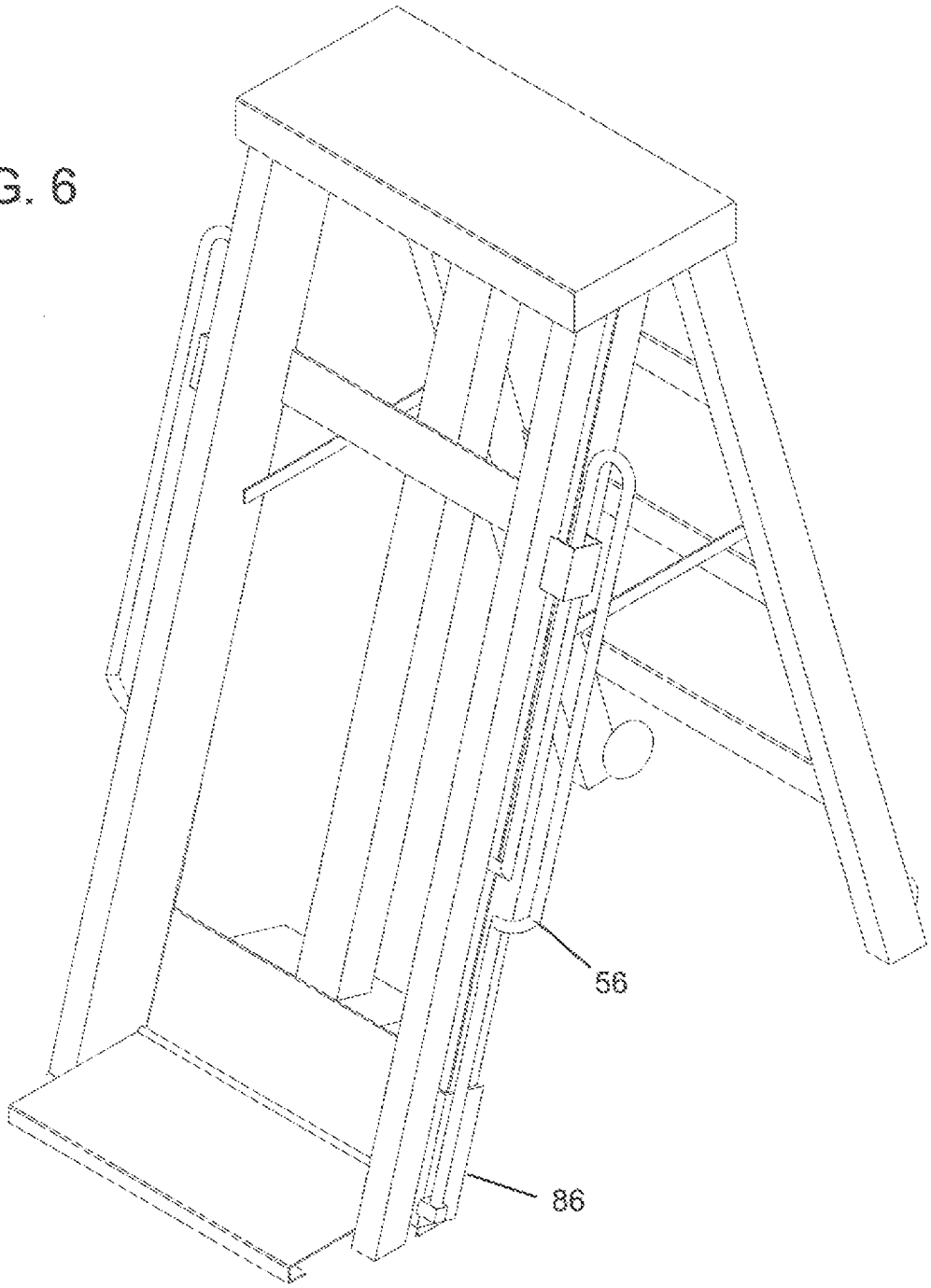
FIG. 6 is a perspective view of an exemplary embodiment of the present invention.

In an alternate embodiment, the motorized gear mechanism 34 may define a channel groove 84 for slidably receiving the gear channel 32, as illustrated in FIG. 4. The vertical plate 14 may include the motorized gear mechanism 34 generally centered on the mechanism side 58 between the first end 50 and the second end 52 so as to straddle the channel groove 84.

The frame 30 may include a pair of vertical members 20 and a plurality of horizontal members 22. The frame 30 may be adapted to support the use of the foldable platform 10 along the gear channel 32. The pair of vertical members 20 may be parallel to one another. The pair of vertical members 20 may be connected to one another at predetermined locations along the length thereof by the plurality of parallel horizontal members 22.

In certain embodiments, each of the vertical members 20 may form a handle slot 24 extending longitudinal along the length thereof, as illustrated in FIG. 1. The handle slots 24 may slidably receive the elongated handles 56 as the foldable platform 10 moves along the gear channel 32. The first end 50 and the second end 52 may include flanges for engaging the pair of vertical members 20.

In an alternate embodiment, each of the vertical members 20 may include a side channel 86 extending along a portion of the length thereof, as illustrated in FIG. 4. Each side channel 86 may form a guide slot 88 along the length thereof. Each guide slot 88 may be adapted to receive the first end 50 or the second end 52 of the vertical plate 14. The first end 50 and the second end 52 may include flanges for engaging each guide slot 88.

In certain embodiments, the pair of vertical members 20 may be pivotably connected to a back support 70 along a pivot plane 76 so that the ladder lift 100 pivots from a closed position to an open position, and vice versa. The pivot plane 76 may be a platform that may be generally horizontal when the ladder lift 100 is in the open position. The back support 70 may include a pair of back legs 72 connected to one another at predetermined locations along the length thereof by a plurality of parallel horizontal supports 74. In certain embodiments, a folding stabilizer may pivotably connect at least one back leg 72 and at least one vertical member 20 so as to stabilize the ladder lift 100 when in the open position.

In certain embodiments, each back leg 72 and vertical member 20 may include at least one gripper cup joined to the end opposite the pivot plane 76. The gripper cups may be adapted to frictionally engage a surface so as to stabilize the ladder lift 100 when in use. In an alternate embodiment, the opposite ends of at least one back leg 72 and/or vertical member 20 may include at least one lockable wheel 82, as illustrated in FIG. 4. The at least one lockable wheel 82 may be adapted to move from a locked position to an unlocked position. In the unlocked position the at least one lockable wheel 82 may be rotatably mounted. In the locked position the at least one lockable wheel 82 may be adapted to engage a surface so as to stabilize the ladder lift 100 when in use.

The gear channel 32 may be positioned between the pair of vertical members 20 and may be parallel thereto. The gear channel 32 may house a belt track 36 extending along the length of the gear channel 32. The motorized gear mechanism 34 may selectively engage the belt track 36 positioned within the gear channel 32 for causing the foldable platform 10 to move in a specified direction along the length of the gear channel 32.

The motorized gear mechanism 34 may house the removable battery 80. The removable battery 80 may be adapted to electrically power the ladder lift 100. The removable battery 80 may include a battery pack electrically connected to a power cord. The removable battery may be removably mounted to the ladder lift 100 so that it may be removed for recharging by, for example, electrically connecting the power cord to an outlet.

The toggle switch 60 may be used to engage and disengage the motorized gear mechanism 34. The toggle switch 60 may cause the motorized gear mechanism 34 to move the foldable platform 10 along the gear channel 32. The toggle switch 60 may provide a variable speed mode that controls the speed at which the foldable platform 10 may be moved along the length of the gear channel 32.

A method of using the present invention may include the following. The ladder lift 100 disclosed above may be provided. A user may be accommodated on the foldable platform 10. Then the user may activate the toggle switch 60 so that the foldable platform 10 moves in a specified direction along the length of the gear channel 32 for a predetermined distance.

It should be understood, of course, that the foregoing relates to exemplary embodiments of the invention and that modifications may be made without departing from the spirit and scope of the invention as set forth in the following claims.

What is claimed is:

1. A ladder lift comprising:

a frame having two spaced apart vertical members, wherein each vertical member defines a handle slot extending along at least a half of its length;

a gear channel housing a belt track, wherein the gear channel is supported by the frame;

a foldable platform comprising:

a vertical plate having a first end and a second end;

two upwardly extending elongated handles, each handle is disposed near a respective end of the vertical plate so that each elongated handle is slidably received through so as to protrude through a respective one of the handle slots;

a horizontal plate, wherein the vertical plate and the horizontal form a general L-shape;

a motorized gear mechanism connected to the vertical plate;

two toggle switches, each toggle switch disposed near a respective distal end of an elongated handle, wherein each toggle switch is configured to engage and disengage the motorized gear mechanism; and wherein the motorized gear mechanism mechanically engages the belt track for causing the foldable platform to move along the length of the gear channel.

2. The ladder lift of claim 1, wherein the vertical plate and the horizontal plate are pivotably connected.

3. The ladder lift of claim 1, further including a back support about which the frame is pivotably connected.

4. The ladder lift of claim 1, wherein the vertical plate defines a vertical aperture between the first and the second end, wherein the vertical aperture slidably receives the gear channel.

5. The ladder lift of claim 1, wherein the motorized gear mechanism defines a channel groove, wherein the channel groove slidably receives the gear channel.

* * * * *